US010896666B2

(12) United States Patent
Nicholson et al.

(10) Patent No.: US 10,896,666 B2
(45) Date of Patent: Jan. 19, 2021

(54) NOISE CANCELLATION WITH VARIABLE DISTANCE

(71) Applicant: Lenovo (Singapore) Pte. Ltd., Singapore (SG)

(72) Inventors: John Weldon Nicholson, Cary, NC (US); Howard Locker, Cary, NC (US); Daryl Cromer, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 16/368,230

(22) Filed: Mar. 28, 2019

(65) Prior Publication Data

US 2020/0312293 A1 Oct. 1, 2020

(51) Int. Cl.

| | |
|---|---|
| ***G10K 11/178*** | (2006.01) |
| ***H04R 3/00*** | (2006.01) |
| ***G10L 21/0208*** | (2013.01) |

(52) U.S. Cl.

CPC .... *G10K 11/17813* (2018.01); *G10L 21/0208* (2013.01)

(58) Field of Classification Search

CPC .. H04R 3/00; H04R 3/005; H04R 3/04; G10L 21/0208; G10L 21/0216; G10L 21/02165; G10L 21/02166

See application file for complete search history.

(56) References Cited

U.S. PATENT DOCUMENTS

| | | | | |
|---|---|---|---|---|
| 9,894,439 | B1 * | 2/2018 | Peeler | H04R 3/005 |
| 2005/0111674 | A1 * | 5/2005 | Hsu | H04R 3/005 381/92 |
| 2008/0246833 | A1 * | 10/2008 | Yasui | H04N 7/142 348/14.08 |
| 2014/0064500 | A1 * | 3/2014 | Lee | H04R 1/1041 381/58 |
| 2014/0337016 | A1 * | 11/2014 | Herbig | H04M 3/568 704/201 |
| 2018/0068673 | A1 * | 3/2018 | Bostick | H04M 1/72569 |

* cited by examiner

*Primary Examiner* — Thang V Tran

(74) *Attorney, Agent, or Firm* — Ference & Associates LLC

(57) ABSTRACT

One embodiment provides a method, including: receiving, at a device employing two or more audio capture devices, an audio signal; determining a distance between two of the two or more audio capture devices capturing the audio signal; and reducing, using a noise cancellation technique employing the determined distance, an amount of unwanted noise from the audio signal. Other aspects are described and claimed.

19 Claims, 6 Drawing Sheets

NOISE CANCELLATION WITH VARIABLE DISTANCE

BACKGROUND

Many companies are moving from individual cubicles and offices to an open office work area. The open office work area may include short cubicles that are not specifically assigned to an individual or may include long tables having chairs or benches on either side for employees to sit and collaborate. However, one drawback to the open office area is when an employee is attempting to conduct a telephone call, background noise is very prevalent for the other telephone call attendees.

Additionally, many employees may work remotely from an office and may, therefore, employ voice-over-internet-protocol, also referred to as voice-over-IP or VOIP, voice call services. These services allow a user to use the Internet to conduct the voice call using a headset or microphone, thereby making the voice call possible from any location having an Internet connection. However, since the VOIP calls can be made from any location, which may not be a quiet location, the other call attendees may hear significant background noise that is picked up by the user's headset or microphone.

BRIEF SUMMARY

In summary, one aspect provides a method, comprising: receiving, at a device employing two or more audio capture devices, an audio signal; determining a distance between two of the two or more audio capture devices capturing the audio signal; and reducing, using a noise cancellation technique employing the determined distance, an amount of unwanted noise from the audio signal.

Another aspect provides an information handling device, comprising: two or more audio capture devices; a processor operatively coupled to the two or more audio capture devices; a memory device that stores instructions executable by the processor to: receive, at the two or more audio capture devices, an audio signal; determine a distance between two of the two or more audio capture devices capturing the audio signal; and reduce, using a noise cancellation technique employing the determined distance, an amount of unwanted noise from the audio signal.

A further aspect provides a product, comprising: a storage device that stores code, the code being executable by a processor and comprising: code that receives, at a device employing two or more audio capture devices, an audio signal; code that determines a distance between two of the two or more audio capture devices capturing the audio signal; and code that reduces, using a noise cancellation technique employing the determined distance, an amount of unwanted noise from the audio signal.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
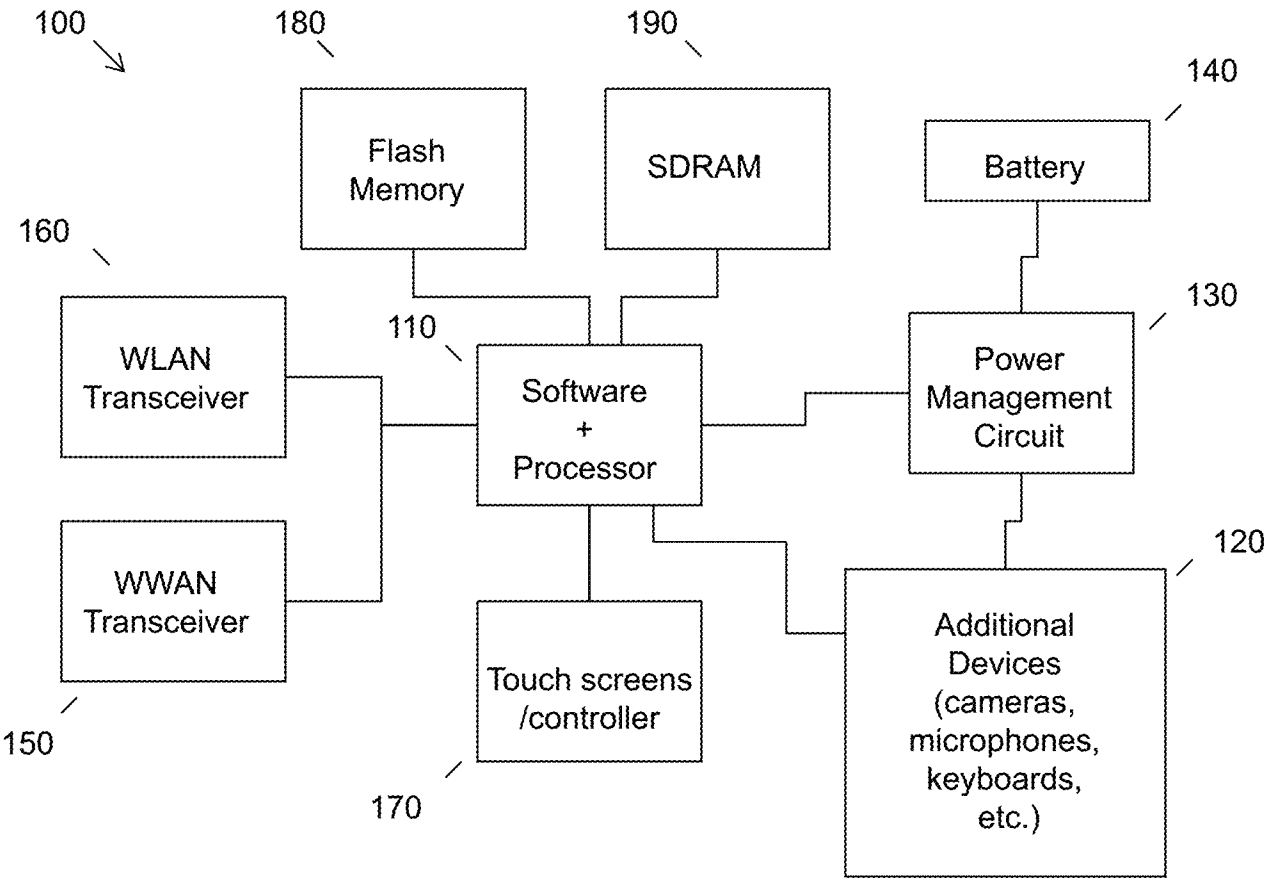
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

To combat the prevalence of background noise on a telephone or voice call, many teleconferencing systems, laptops, and automobiles employ a technique called beamforming. Beamforming is effectively a technique for noise cancellation through simulated directionality. However, the beamforming technique requires at least two microphones and additionally requires knowledge of the distance between the microphones. Beamforming works to attenuate noise behind and on the sides of the microphone(s) and/or other audio capture device(s). Generally, beamforming works by delaying a signal received by the microphone in the set that receives the signal first based upon a distance between the two microphones. Thus, knowing the distance between the group of microphones and/or audio capture devices is critical to accurately cancelling noise surrounding the user.

Thus, the use of beamforming for noise cancellation has been confined to systems that include fixed microphones and/or audio capture devices. If the distance between the microphones and/or audio capture devices is variable, the beamforming technique is inaccurate and does not work to cancel the background noise. Therefore, users either have to use a specific microphone and/or other audio capture device set-up or, if the user would like to use a different set-up, the user has to either find a quiet location to conduct the voice call or the call attendees are subjected to the background noise. Many users prefer headsets, for example, horse-collar headsets, over-the-ear headsets, or the like, to perform voice calls. Since, if these headsets included multiple microphones, the distance between the microphones would be variable based upon characteristics of the user (e.g., head size, neck size, etc.) or how the user wears the headset, the beamforming technique would not be effective for noise cancellation. Thus, these headsets only have one microphone and do not utilize the beamforming technique for noise cancellation.

Accordingly, an embodiment provides a method for determining a distance between two audio capture devices capturing an audio signal and employing a noise cancellation technique to reduce unwanted noise based upon the distance. An embodiment may receive an audio signal. The audio signal may include both voice input, for example, voice input of a user utilizing the device, and unwanted noise, for example, background noise. Receipt of the audio signal may be at a device, for example, a headset, information handling device, or the like, employing two or more audio capture devices (e.g., microphones, audio pick-up devices, etc.). For ease of reading, the example of a user utilizing a headset will be used here throughout. However, it should be understood that the systems and methods described herein can be applied to any device or system that employs two or more audio capture devices.

An embodiment may determine the distance between two of the two or more audio capture devices. In the case that the device includes more than two audio capture devices, an embodiment will determine a distance between each of the audio capture devices and each of the other audio capture devices. The distance determination may be performed before receipt of the audio signal, during receipt of the audio signal, or directly after receipt of the audio signal. Based upon the determined distance an embodiment may employ a noise cancellation technique, for example, beamforming, that employs the determined distance to reduce, which may include minimizing or altogether eliminating, the unwanted noise from the audio signal.

Since the distance determination can be made in real-time or at any time, the noise cancellation technique computation can also be made in real-time or at any time. Thus, if the distance between the audio capture devices changes or has the ability to change, the noise cancellation computation can be modified to account for the variable distance. In other words, rather than requiring a fixed distance between the two audio capture devices in order to perform beamforming or another noise cancellation technique that relies on a distance determination, an embodiment may employ one of these noise cancellation techniques in a device where the distance may be variable. Thus, the described system provides a technical improvement over the conventional techniques by allowing use of the a noise cancellation technique that relies on a distance for the noise cancellation computation even with the use of two or more microphones and/or audio capture devices where the distance there between is variable.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system on a chip design found for example in tablet or other mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110. Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are commonly included, e.g., an image sensor such as a camera, audio capture device such as a microphone, external keyboard, other input devices, etc. System 100 often includes one or more touch screens 170 for data input and display/rendering. System 100 also typically includes various memory devices, for example flash memory 180 and SDRAM 190.

Figure 2:
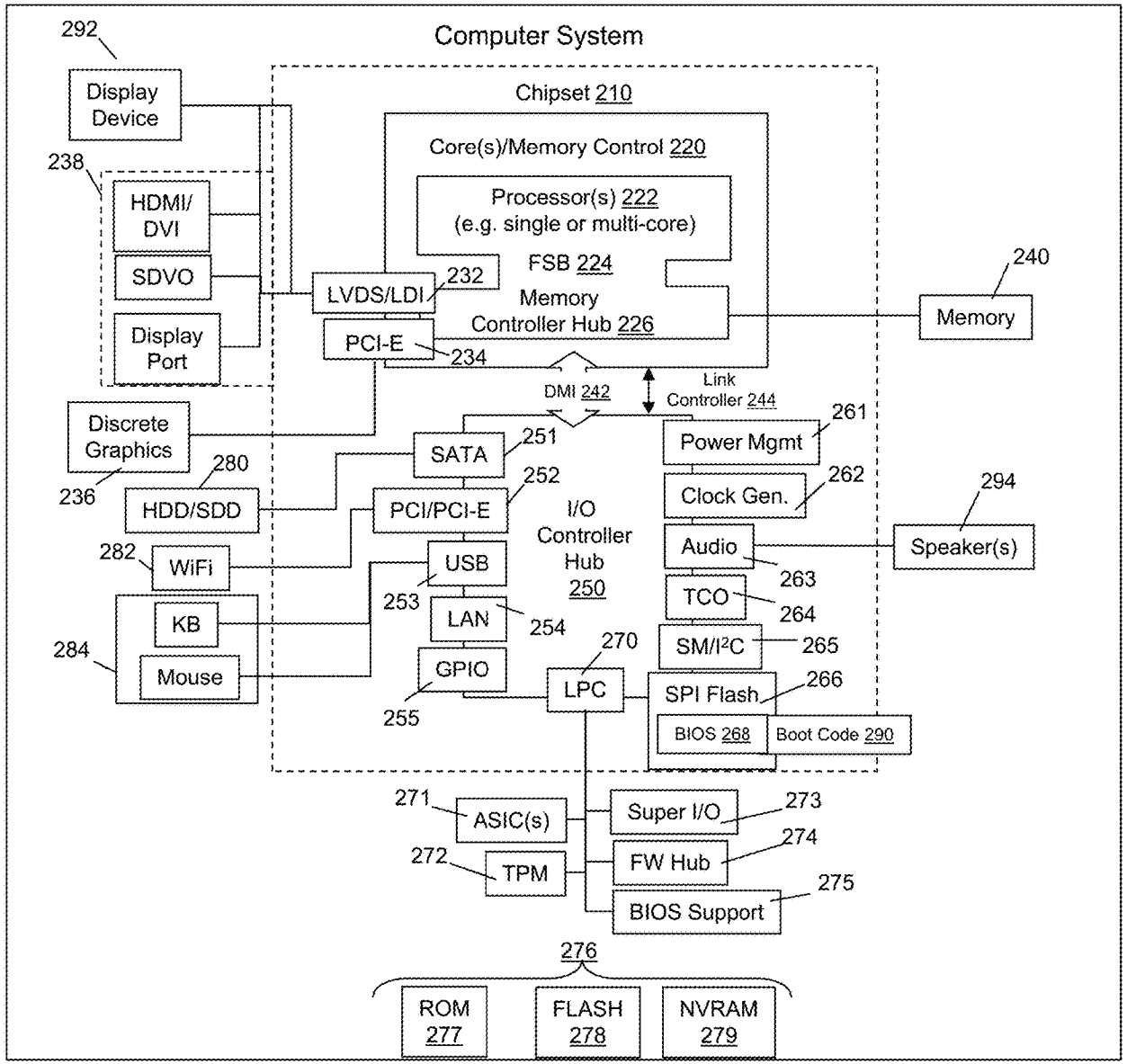
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in devices such as smart phones, tablets, laptops, personal computer devices generally, and/or other electronic devices that may be capable of engaging in online conference applications, performing noise cancellation functions, or the like. For example, the circuitry outlined in FIG. 1 may be implemented in a tablet or smart phone embodiment, whereas the circuitry outlined in FIG. 2 may be implemented in a laptop.

Figure 3:
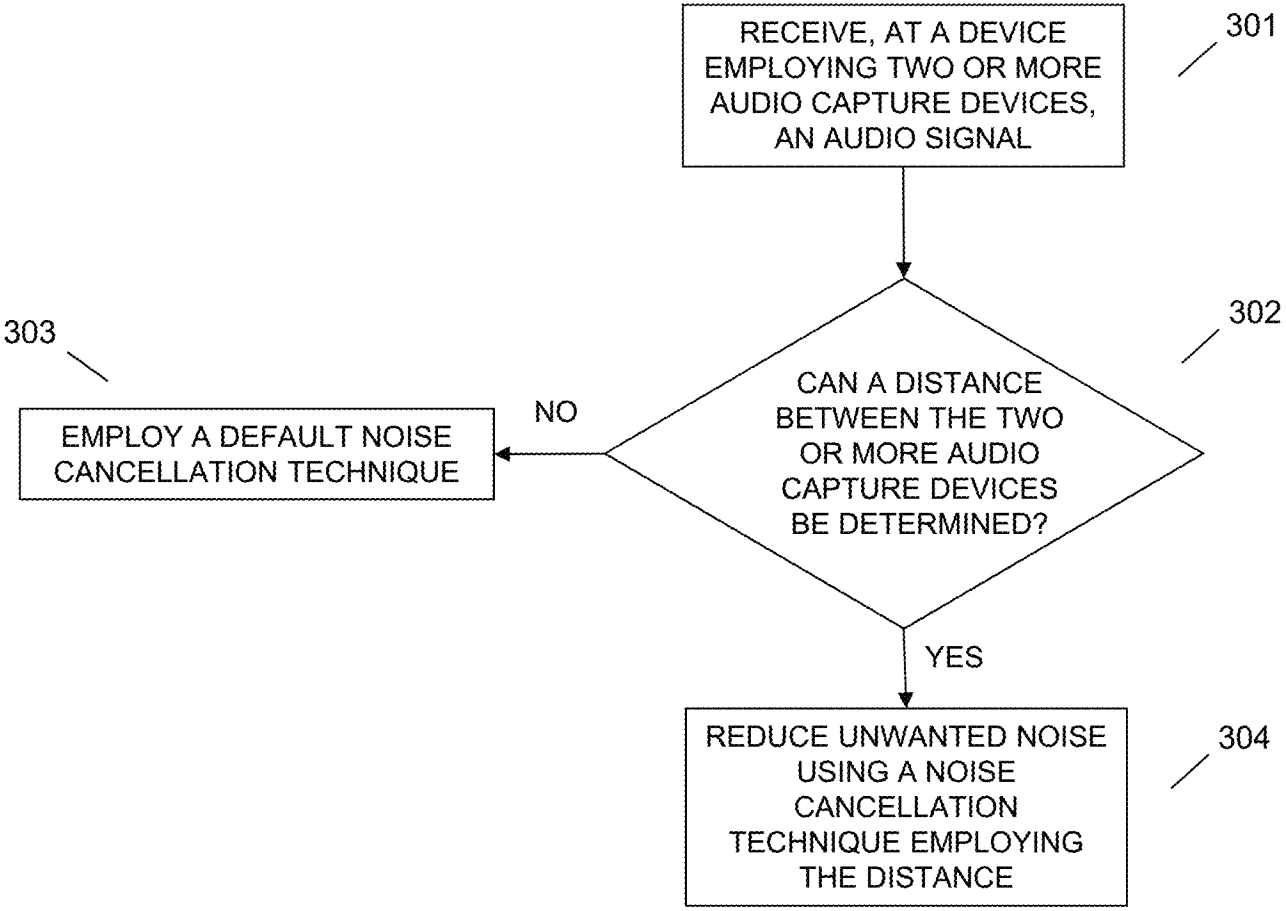
FIG. 3 illustrates an example method of determining a distance between two audio capture devices capturing an audio signal and employing a noise cancellation technique to reduce unwanted noise based upon the distance.

Referring now to FIG. 3, an embodiment may determine a distance between two audio capture devices capturing an audio signal and employ a noise cancellation technique to reduce unwanted noise based upon the distance. At 301, an embodiment may receive an audio signal. The audio signal may be received at a device employing two or more audio capture devices, for example, a headset, information handling device, or the like. An audio capture device may be a microphone or other audio pick-up device. Thus, the device may include two or more microphones, audio pick-up devices, or combination thereof. It should be noted that the described systems and methods may be employed with more than two audio capture devices. In this case, as described in more detail below, an embodiment may perform distance calculations between each of the audio capture devices and each of the other audio capture devices. For example, if the device includes three audio capture devices, A, B, and C, an embodiment may make a distance determination for the following pairs, A and B, A and C, and B and C. While the example of pairs has been used, it should be understood that many noise cancellation techniques, including beamforming, allow for calculations using more than pairs, for example, three or four audio capture devices. In other words, using the example above, an embodiment may perform the calculation on all of A, B, and C at the same time.

As stated herein, the example of a user having an audio headset and making a voice call using the headset will be used herein throughout. Thus, using this example, the audio signal may include both desired audio, for example, the user speaking into the headset, and undesired or unwanted audio, for example, background noise, other users speaking, or the like. The unwanted noise may be any noise or audio that is unwanted by the user utilizing the headset or other device. For example, if the device is employed in an office environment, the unwanted noise may be other employees talking, device (e.g., printers, servers, etc.) noises, typing, or the like.

At 302, an embodiment may determine whether a distance between at least two of the two or more audio capture devices capturing the audio signal can be determined or otherwise identified. Since the distance between the audio capture devices may be variable, for example, due to the type of device (e.g., a horse-collar audio headset, an over-the-ear audio headset, etc.), an embodiment attempts to determine the current distance between two of the audio capture devices. The current distance is the distance that is determined whenever the distance determination occurs. As stated elsewhere herein, the distance determination occurs between two of the audio capture devices. Thus, if the device has more than two audio capture devices, the distance determination may occur for each pair of audio capture devices or may occur for all of the audio capture devices at the same time with the distance being with respect to the audio source or a central location.

The distance determination may be made shortly before receipt of the audio signal, during receipt of the audio signal, or shortly after receipt of the audio signal. For example, the distance determination may be made by an embodiment in real-time or close to real-time with respect to the receipt of the audio signal. Alternatively, an embodiment may make the distance determination at periodic intervals during receipt of the audio signals. For example, an embodiment may perform the distance determination every five seconds, every minute, every thirty seconds, or the like, and then use the determined distance for the noise cancellation technique calculation until a new distance determination is made. As another alternative, the distance determination may be performed upon receipt of a trigger. The trigger may be any number of events that may indicate a distance determination should be made. Example trigger events include movement of the user which may indicate that the distance has changed, upon receipt of an audio signal having unwanted noise, when a user starts a voice call, when a user starts speaking, movement of the device, or the like.

The latter two techniques may provide techniques that reduce the amount of processing resources necessary for performing the distance determination and noise cancellation calculation. An embodiment may also preform the distance determination using a combination of the above techniques. For example, an embodiment may perform continuous or real-time distance determination while the user employing the device is speaking and then only perform the determination at predetermined intervals or when a trigger is received when the user is not speaking. As another example, an embodiment may perform the distance determination when at predetermined intervals and also when a trigger is received. In other words, if a trigger is received a distance determination may be made and then a distance determination may be made at predetermined intervals until another trigger is received.

To make a distance determination an embodiment may employ a variety of techniques, including a combination thereof. One distance determination technique may employ the use of one or more image capture devices (e.g., video camera, still camera, infrared camera, etc.). The one or more image capture devices may be located on the device, located on a device in proximity to the device, or the like. For example, if a user is employing a headset for a VOIP voice call, then the user is likely employing a second device, for example, a laptop, computer, tablet, smart phone, or other information handling device, to connect to the Internet. In this example, an embodiment may employ an image capture device included on this second device for capturing an image of the audio headset that the user is employing. As another example, if the user is in a room the room may have cameras located around the room. In this example, an embodiment may employ these cameras for capturing an image of the audio headset or other device.

The image capture device(s) may capture one or more images of the device, using the working example, the audio headset. An embodiment may then use computer vision techniques, image analysis techniques, or the like, to identify a location of the two or more audio capture devices within the image. Due to the fact that the image will include other features, for example, the user's face, background objects, the remaining portion of the device itself, and the like, an embodiment can use the camera vision techniques, image analysis techniques, or the like, to determine a distance between the two or more audio capture devices. In other words, since the image would include features that could be used to provide a scale or known distance measurement, an embodiment could extrapolate or otherwise correlate the known distance measurement to determine the distance between the audio capture devices.

The device may also include at least one light source or other marker for each of the audio capture devices. These light sources, for example, an additional device illustrated in FIG. 1 at 120, may be located at a fixed position relative to each of the audio capture devices. In other words, upon manufacture, a light source may be positioned at a specific distance from each of the audio capture devices, for example, each audio capture devices may have a light source that is located three millimeters above the audio capture device. These light sources may be any type of light source, for example, light-emitting diodes (LEDs), incandescent, or the like. From the image an embodiment may identify the location of the audio capture devices based upon identifying the location of the light sources or other markers. By knowing the fixed position of the light source or other marker with respect to the audio capture device, an embodiment may identify the distance between the audio capture devices. The light sources or other markers may also use infrared wavelength, blinking, or the like, to communicate a status of the audio capture devices and/or location of the audio capture device.

Another additional or alternative technique for making the distance determination may include using a bend sensor within the device, for example, an additional device illustrated in FIG. 1 at 120. If the device includes an audio headset, the audio headset generally includes a flexible piece. For example, an over-the-ear audio headset includes the flexible headband portion of the audio headset. As another example, a horse-collar audio headset includes a flexible wire connecting the two headphone/speaker portions. The flexible portion may include a bend sensor, for example, a conductive thread sandwiched between rubber or other sturdy material. The bend sensor reacts to pressure, which may be a result of bend, with a decrease in resistance. Thus, as the flexible material is bent, pressure is exerted on the bend sensor. The change in resistance by the bend sensor can be measured and then correlated with how much pressure is being exerted. This amount of pressure can then be correlated to an amount of bend, thereby allowing determination of a bend angle.

Since an embodiment knows the distance between audio capture devices from manufacturing, an embodiment can determine the current or "wear" distance between the audio capture devices based upon this bend angle. In other words, the audio capture devices were manufactured within the device having a particular distance therebetween. This distance would be an accurate distance if device is not being worn or in a neutral position. However, when a user utilizes the device the distance between the audio capture devices changes. Thus, by determining the bend angle, an embodiment can compute the distance between the audio capture devices as the device is being utilized or in a "wear" position using the known manufacturing distance and the bend angle. Other methods and techniques for determining the distance between the audio capture devices are possible and contemplated.

If the distance between the audio capture devices cannot be determined at 302, an embodiment may employ a default noise cancellation technique at 303. Alternatively, an embodiment may employ a default distance, for example, the manufacturer distance, for the noise cancellation technique computation. If, on the other hand, the distance between the audio capture devices can be determined at 302, an embodiment may reduce unwanted noise using a noise cancellation technique that utilizes the determined distance at 304.

Reducing an amount of unwanted noise from the audio signal may include minimizing or altogether eliminating the unwanted noise from the audio signal. As stated before, the unwanted noise may include background noise, other users talking, or the like. In other words, unwanted noise may include any noise in the audio signal that is not the user employing the device speaking. Thus, an embodiment may be able to minimize or eliminate this unwanted or undesired noise from the audio signal. To reduce the unwanted noise, an embodiment by employing a noise cancellation technique, for example, beamforming.

Beamforming relies on knowing a distance between the audio capture devices. For example, referring to FIG. 4, which illustrates an example "endfire" beamforming technique used when the audio capture devices are in front of and behind each other with respect to the audio signal, the audio signal 401, in this case the user speaking and other unwanted noise, is received at two audio capture devices 402 (Mic 1 and Mic 2). Due to the fact the two audio capture devices are located at different locations, the audio signal is received at both of them at different times. In other words, there is a delay between the receipt of the audio signal at one audio capture device and the receipt of the audio signal at the other audio capture device. Knowing the distance 403 between the two audio capture devices allows an embodiment to determine what the delay should be between receipt of the audio signals at the two audio capture devices.

For example, at 20° C. the speed of sound in air is 343 m/sec, therefore, a sound wave travels about 1 mm in 3 μs. Thus, if the audio capture devices are 6 mm apart, then the delay would need to be 18 μs. On the other hand, if the audio capture devices are 7 mm apart, then the delay would need to be 21 μs. Therefore, if an embodiment knows the distance 403, as determined at 302, an embodiment can select the correct delay 404 for the output audio signal 405.

Figure 5:
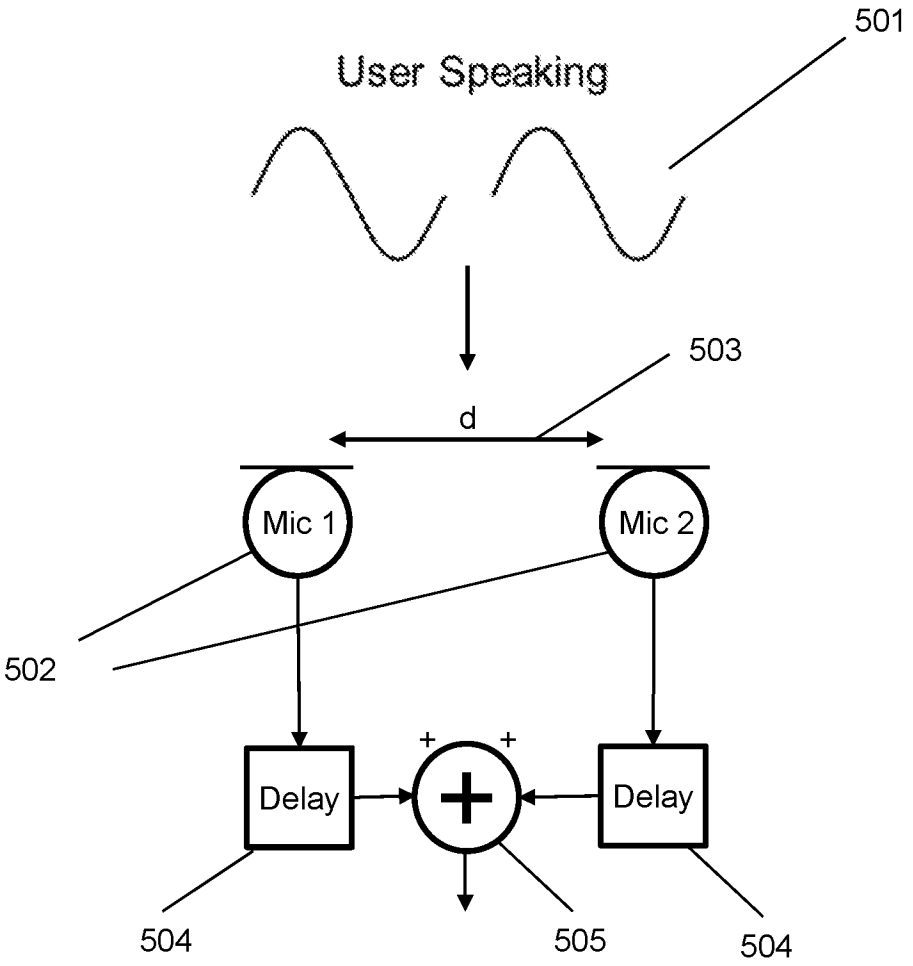
FIG. 5 illustrates an example of using two audio capture devices to perform noise cancelling based upon a determined distance in an "broadside" beamforming configuration.

Beamforming can also be used with an array of audio capture devices that are located next to each other. FIG. 5 illustrates an example "broadside" beamforming technique used when the audio capture devices are next to each other with respect to the audio signal. The audio signal 501, again the user speaking and unwanted noise, is received at two audio capture devices 502 (Mic 1 and Mic 2). Since the audio signal would be traveling at different angles with respect to the audio capture devices, the audio signal is received at different times by each of the audio capture devices. In other words, there is a delay between the receipt of the audio signal at one audio capture device and the receipt of the audio signal at the other audio capture device. Knowing the distance 503 between the two audio capture devices 502 allows an embodiment to determine what the delay 504 should be between receipt of the audio signals at the two audio capture devices. Therefore, the system can select the correct delay 504 for the output audio signal 505.

Figure 4:
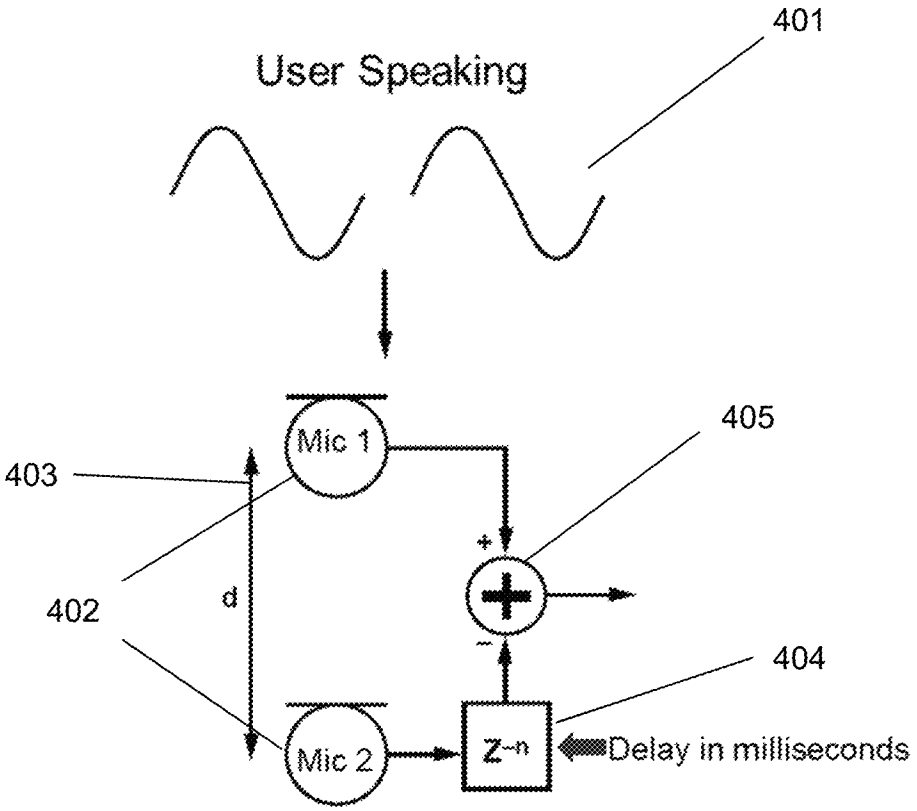
FIG. 4 illustrates an example of using two audio capture devices to perform noise cancelling based upon a determined distance in an "endfire" beamforming configuration.
Figure 6:
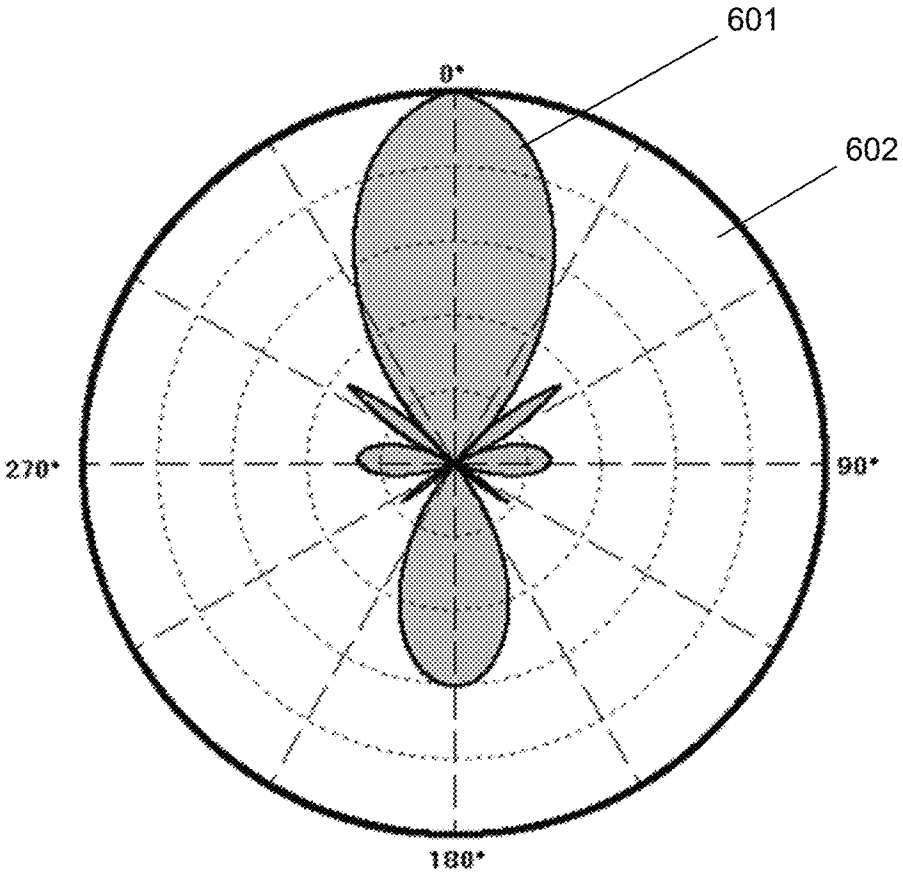
FIG. 6 illustrates an example hyper cardioid response field generated from use of a noise cancellation technique.

Either of the arrangements of FIG. 4 or FIG. 5 results in a hyper cardioid response field, or sound field, as shown in FIG. 6. Where the desired audio signal is found in region 601 and the unwanted sound is found in region 602. The sound located in region 602 then can be attenuated, cancelled, or otherwise modulated to reduce the unwanted noise found behind or around the user.

Once an embodiment has reduced the amount of unwanted noise from the audio signal at 304, an embodiment may transmit the modified audio signal to another device. The modified audio signal is the received audio signal having the reduced amount of unwanted noise. In other words, the modified audio signal is the received audio signal minus the unwanted noise. The modified audio signal may be transmitted to a device that the user is using to conduct the voice call, for example, the information handling device. This signal can then be transmitted to the other call attendees without, or at least having a reduced amount, of unwanted noise, thereby providing a system that allows the other call attendees to be exposed to less unwanted noise disturbance and also able to more clearly understand the user employing the device.

Thus, the various embodiments described herein represent a technical improvement to conventional noise cancellation techniques by allowing the use of the beamforming noise cancellation technique even when the user is employing a headset or other microphone set-up where the distance between the microphone(s) and/or other audio capture device(s) may be variable. Embodiments provide a method of dynamically determining the distance between the microphone(s) and/or other audio capture devices and, thus, automatically modifying the beamforming calculation, in real-time or close to real-time, to take into account the variable distance. Thus, the described systems and methods provide a technical improvement that allows a user to use any type of headset, microphone, or other audio capture device set-up that the user chooses, while still allowing for the minimization or cancellation of background noise so that other call attendees are not distracted by the background noise of the user.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, a system, apparatus, or device (e.g., an electronic, magnetic, optical, electromagnetic, infrared, or semiconductor system, apparatus, or device) or any suitable combination of the foregoing. More specific examples of a storage device/medium include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising:

receiving, at a device employing two or more audio capture devices, an audio signal;

determining, at substantially the time of receipt of the audio signal, a distance between two of the two or more audio capture devices capturing the audio signal, wherein the determined distance comprises a distance between the two or more audio capture devices at the time of receipt of the audio signal, wherein the determined distance is variable between receipt of audio signals; and reducing, using a noise cancellation technique that is based upon the distance being variable and that employs the determined distance, an amount of unwanted noise from the audio signal.

2. The method of claim 1, wherein the determining comprises capturing, using an image capture device, an image of the device.

3. The method of claim 2, wherein the determining comprises identifying, using an image analysis technique on the image, a location of the two or more audio capture devices within the image.

4. The method of claim 2, wherein the device comprises at least one light source for each of the two or more audio devices, the at least one light source located at a fixed position with relation to each of the two or more audio capture devices; and wherein the determining comprises identifying, using an image analysis technique on the image, a location of the at least one light source for each of the two or more audio devices.

5. The method of claim 1, wherein the device comprises an audio headset comprising a bend sensor located in a structural element connecting and between the two or more audio capture devices; and wherein the determining a distance comprises identifying an angle of bend of the bend sensor and calculating the distance between the two or more audio capture devices based upon the angle of bend.

6. The method of claim 1, wherein the determining occurs at a time selected from the group consisting of: during receipt of the audio signal and responsive to receipt of the audio signal.

7. The method of claim 1, wherein the noise cancellation technique comprises beamforming.

8. The method of claim 1, wherein the received audio signal comprises voice input and wherein the unwanted noise comprises noise other than the voice input.

9. The method of claim 1, further comprising transmitting, to at least one device, a modified audio signal, the modified audio signal comprising the audio signal having the reduced amount of unwanted noise.

10. An information handling device, comprising:

two or more audio capture devices;

a processor operatively coupled to the two or more audio capture devices;

a memory device that stores instructions executable by the processor to:

receive, at the two or more audio capture devices, an audio signal;

determine, at substantially the time of receipt of the audio signal, a distance between two of the two or more audio capture devices capturing the audio signal, wherein the determined distance comprises a distance between the two or more audio capture devices at the time of receipt of the audio signal, wherein the determined distance is variable between receipt of audio signals; and reduce, using a noise cancellation technique that is based upon the distance being variable and that employs the determined distance, an amount of unwanted noise from the audio signal.

11. The information handling device of claim 10, wherein the instructions to determine comprise instructions to capture, using an image capture device, an image of the device.

12. The information handling device of claim 11, wherein the instructions to determine comprise instructions to identify, using an image analysis technique on the image, a location of the two or more audio capture devices within the image.

13. The information handling device of claim 11, further comprising at least one light source for each of the two or more audio devices, the at least one light source located at a fixed position with relation to each of the two or more audio capture devices; and wherein the instructions to determine comprise instructions to identify, using an image analysis technique on the image, a location of the at least one light source for each of the two or more audio devices.

14. The information handling device of claim 10, wherein the information handling device comprises an audio headset comprising a bend sensor located in a structural element connecting and between the two or more audio capture devices.

15. The information handling device of claim 14, wherein the instructions to determine comprise instructions to identify an angle of bend of the bend sensor and instructions to calculate the distance between the two or more audio capture devices based upon the angle of bend.

16. The information handling device of claim 10, wherein the instructions to determine occur at a time selected from the group consisting of: during receipt of the audio signal and responsive to receipt of the audio signal.

17. The information handling device of claim 10, wherein the noise cancellation technique comprises beamforming.

18. The information handling device of claim 10, wherein the instructions further comprise instructions to transmit, to at least one device, a modified audio signal, the modified audio signal comprising the audio signal having the reduced amount of unwanted noise.

19. A product, comprising:

a storage device that stores code, the code being executable by a processor and comprising:

code that receives, at a device employing two or more audio capture devices, an audio signal;

code that determines, at substantially the time of receipt of the audio signal, a distance between two of the two or more audio capture devices capturing the audio signal, wherein the determined distance comprises a distance between the two or more audio capture devices at the time of receipt of the audio signal, wherein the determined distance is variable between receipt of audio signals; and code that reduces, using a noise cancellation technique that is based upon the distance being variable and that employs the determined distance, an amount of unwanted noise from the audio signal.

* * * * *